US008373337B2

(12) United States Patent
Kaiser et al.

(10) Patent No.: US 8,373,337 B2
(45) Date of Patent: Feb. 12, 2013

(54) SPARK PLUG HAVING A REDUCED PHYSICAL VOLUME

(75) Inventors: Thomas Kaiser, Aranjuez (ES); Hermann Kersting, Ludwigsburg (DE); Dirk Scholz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 306 days.

(21) Appl. No.: 12/308,480

(22) PCT Filed: Jul. 18, 2007

(86) PCT No.: PCT/EP2007/057443
§ 371 (c)(1),
(2), (4) Date: Aug. 20, 2010

(87) PCT Pub. No.: WO2008/015107
PCT Pub. Date: Feb. 7, 2008

(65) Prior Publication Data

US 2010/0301733 A1 Dec. 2, 2010

(30) Foreign Application Priority Data

Aug. 2, 2006 (DE) ..... 10 2006 035 980

(51) Int. Cl.
*H01T 13/20* (2006.01)
*F02M 57/06* (2006.01)

(52) U.S. Cl. ..... 313/143; 313/118

(58) Field of Classification Search ..... None
See application file for complete search history.

(56) References Cited

U.S. PATENT DOCUMENTS 6,170,451 B1 * 1/2001 Moriya ..... 123/169 PA
6,559,577 B2 * 5/2003 Okazaki et al. ..... 313/118
6,759,796 B2 * 7/2004 Klett et al. ..... 313/143
(Continued)

FOREIGN PATENT DOCUMENTS

DE 19940455 3/2001
DE 10047498 4/2002
(Continued)

OTHER PUBLICATIONS

International Search Report, PCT International Patent Application No. PCT/EP2007/057443, dated Oct. 5, 2007.

*Primary Examiner* — Anh Mai
*Assistant Examiner* — Britt D Hanley
(74) *Attorney, Agent, or Firm* — Kenyon & Kenyon LLP

(57) ABSTRACT

A spark plug for an internal combustion engine, including an electrical connecting arrangement on a connection-side end, an end on the combustion-chamber side pointing toward a combustion chamber, an insulator and a housing having a thread for attaching the spark plug to an engine component, a first sealing area and a second sealing area being provided between the insulator and the housing, the first sealing area being situated closer to the connection-side end and the second sealing area being situated closer to the end on the combustion-chamber side, a tool engagement area for transmitting a torque to the spark plug for fitting or removing the spark plug being situated in an area of the spark plug which lies between the connection-side end and the first sealing area.

8 Claims, 4 Drawing Sheets

U.S. PATENT DOCUMENTS

| | | | | |
|---|---|---|---|---|
| 6,819,030 | B2 * | 11/2004 | Lipp et al. | 313/118 |
| 6,822,377 | B1 | 11/2004 | Venn et al. | |
| 2002/0057044 | A1 | 5/2002 | Klett et al. | |
| 2002/0067112 | A1 * | 6/2002 | Suzuki et al. | 313/143 |
| 2003/0214210 | A1 | 11/2003 | Lipp et al. | |
| 2005/0218771 | A1 * | 10/2005 | Hrastnik et al. | 313/141 |
| 2005/0284454 | A1 * | 12/2005 | Iwami et al. | 123/635 |
| 2006/0113883 | A1 * | 6/2006 | Kanao | 313/141 |
| 2007/0210688 | A1 * | 9/2007 | Suzuki et al. | 313/141 |

FOREIGN PATENT DOCUMENTS

| | | |
|---|---|---|
| DE | 10257995 | 10/2003 |
| DE | 102005044267 | 3/2007 |
| JP | 60230387 | 11/1985 |

* cited by examiner

SPARK PLUG HAVING A REDUCED PHYSICAL VOLUME

FIELD OF THE INVENTION

The present invention relates to a spark plug for an internal combustion engine.

BACKGROUND INFORMATION

Conventional spark plugs for internal combustion engines are available in different designs. For example, a spark plug which has a tubular, metallic housing and a screw thread embossed thereon is described in German Patent Application No. DE 199 40 455 A1. To minimize corrosion, at least part of the metallic housing is provided with an electroplated coating as protection. Due to more recent engine developments, however, the physical volume available for a spark plug is decreasing. Modern engines have multiple valves, usually between four and five valves per cylinder. To obtain a better charge and thereby also improved performance, larger intake valve diameters, in particular, are also desirable. The higher power densities also require larger cooling ducts. In engines having direct fuel injection, an additional physical volume is needed for at least one injection valve. Therefore, increasingly less of the physical volume provided for each cylinder is available for a spark plug. However, since the spark plug is a wearing part and must therefore be replaced after a certain number of hours of use, the spark plug must be situated on the cylinder in such a way that it can be removed. The conventional spark plugs have a thread and a hexagonal engagement surface for this purpose on the outer housing of the spark plug, it usually being possible to apply a tool having a wrench size of 16 to the hexagonal engagement surface. Since the tool itself surrounds the outside of the hosing, and therefore has a standardized outer diameter, the physical volume for the spark plug must be designed as a function of the maximum outer diameter of the tool. A certain amount of space must therefore also be provided for a tool engagement.

SUMMARY

The spark plug according to the present invention, may have the advantage that its diameter may be significantly reduced in comparison with conventional spark plugs. This makes it possible to give the entire spark plug a narrower design and, in particular, to reduce the physical volume needed for the spark plug. It is also possible, according to the present invention, to reduce the physical volume previously required according to the related art for a tool for fitting and removing the spark plug. The total physical volume needed for the spark plug, including the physical volume for the spark plug and for a tool, is thus reduced, in particular in the direction of the end of the spark plug on the combustion-chamber side. This makes it possible to substantially improve the positioning of the spark plug on a cylinder head. This is achieved, according to the present invention, by situating a tool engagement area in which a tool engages for fitting and removing the spark plug, in an area of the spark plug which lies between a connection-side end of the spark plug and a first sealing area between an insulator and a housing, starting from the connection-side end to the end of the spark plug on the combustion-chamber side. The first sealing area, which is located closer to the connection-side end, and a second sealing area, which is located closer to the combustion chamber, are usually provided between the insulator and the housing of the spark plug. The tool engagement area is thus moved in the direction of the connection-side end of the spark plug. Conventionally, a tool engagement area is always situated between the first and second sealing areas, due to the structure of the spark plug. According to the present invention, it is now possible to give an area of the spark plug on the combustion-chamber side a very narrow design and a small diameter. It is also possible, according to the present invention, to substantially reduce the amount of space required for a tool.

The maximum outer diameter of the spark plug housing, due to the function of the spark plug, is also preferably greater than or equal to a diameter of a tool engagement area. In this regard, for example, a diameter of approximately 16 mm may be used for the spark plug housing, and a substantially reduced diameter may be used for the tool engagement area. It should be noted that the tool engagement area is preferably situated on the housing, the housing being extended over the second sealing area in the direction of the connection-side end of the spark plug, and the tool engagement area being situated on this extension.

The tool engagement area is preferably designed as a hexagon. This makes it possible to change the spark plug using a standard tool as well as a wrench or the like. In particular, the hexagon preferably has a wrench size of 12 or 13.

According to another preferred exemplary embodiment of the present invention, the tool engagement area includes a sleeve area having a tool engagement arrangement. The tool engagement arrangement is preferably a groove or a bore. A tool having a shape which matches the tool engagement means may thus be used to fit or remove a spark plug of this type. The spark plug may thereby be fitted or removed using a particularly narrow tool which is applied in the axial direction of the spark plug.

According to another preferred embodiment of the present invention, the tool engagement area is situated on an electrical connecting arrangement of the spark plug. The electrical connecting arrangement is located on the connection-side end of the spark plug and therefore has a dual function, namely to provide the electrical connection and to function as a tool engagement area. This eliminates the need to provide a separate component having a tool engagement area.

The tool engagement area on the electrical connecting arrangement is preferably provided on a connecting bolt of the spark plug. In particular, the tool engagement area is preferably provided on an end face of the connecting bolt pointing toward the end of the spark plug. The tool engagement area may be, for example, a recess for engagement with a screw driver or an Allen wrench, or an asymmetrically situated bore for engaging with a special tool. It is also possible to provide a hexagon or the like at the end of the connecting bolt. The tool engagement area may also have, for example, a Torx geometry, which has the advantage of being easier to manufacture than a hexagon socket. Due to this measure according to the present invention, a tool engagement point on the spark plug is moved even farther away from the end of the spark plug on the combustion-chamber side, making it possible to further reduce the physical volume required for a tool.

Alternatively, the tool engagement arrangement may also be provided on the side of the electrical connecting means. The tool engagement means is preferably designed, in particular, as a groove or a bore.

The present invention may be used for all types of spark plugs, in particular for conventional spark plugs having electrodes or for laser spark plugs. By moving the engagement point of a tool from the half of the spark plug on the combustion-chamber side to the connection-side half of the spark plug, it is therefore possible, in particular, to reduce a physical volume required for the tool. This makes it possible to provide a particularly narrow spark plug which is optimized with regard to its outer dimensions.

BRIEF DESCRIPTION OF THE DRAWINGS

Preferred exemplary embodiments of the present invention are described below with reference to the figures.

DETAILED DESCRIPTION OF EXAMPLE EMBODIMENTS

A spark plug 1 according to a first exemplary embodiment of the present invention is described below with reference to FIG. 1.

Figure 1:
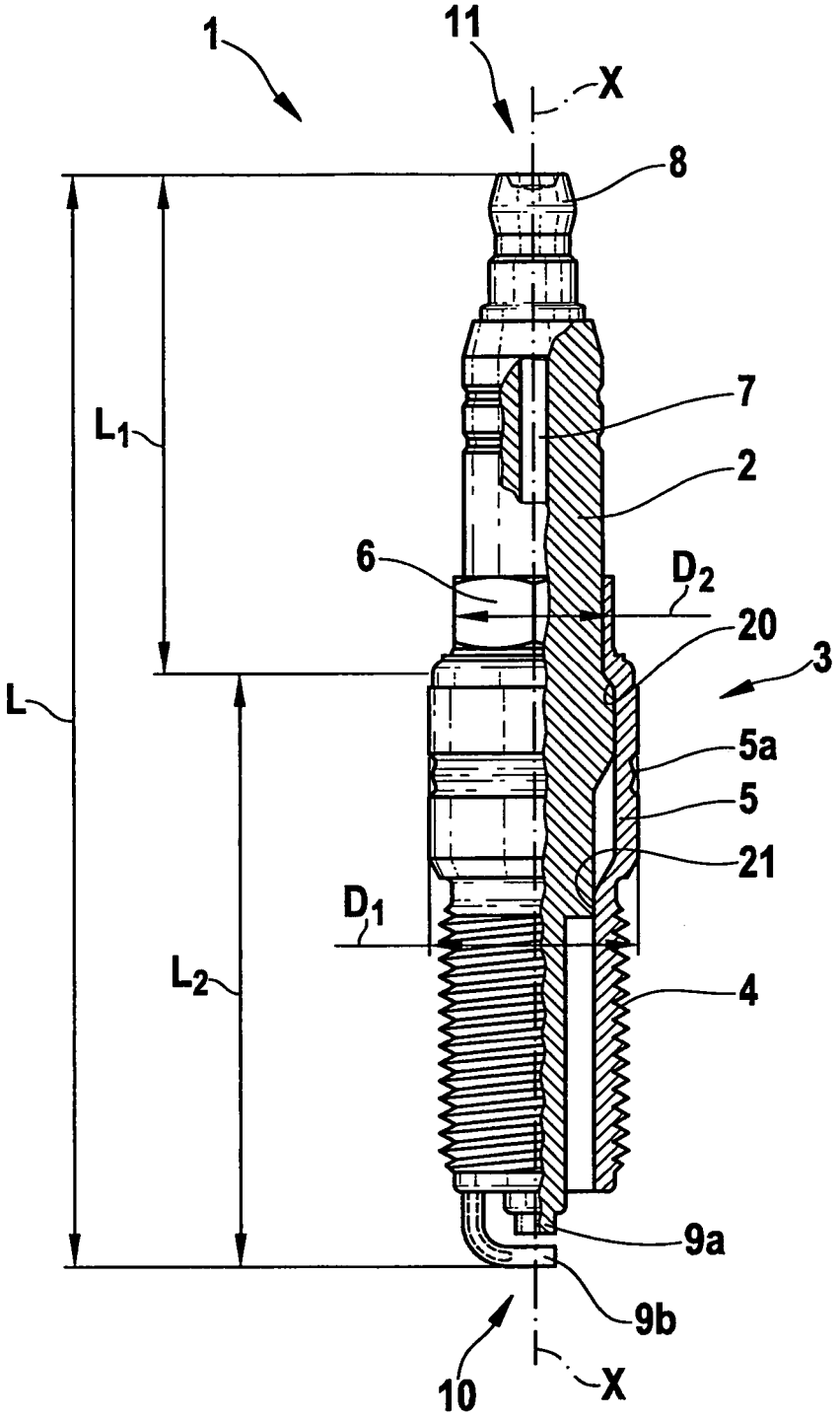
FIG. 1 shows a schematic, partially cut-away side view of a spark plug according to a first exemplary embodiment of the present invention.

As shown in FIG. 1, spark plug 1 includes an insulator 2 and a housing 3 made of metal. The electrode area of the spark plug includes electrodes 9*a* and 9*b*, which are situated at end 10 of spark plug 1 on the combustion-chamber side. The end of the electrode on the combustion-chamber side is defined by the ground electrode. Spark plug 1 also includes a housing 3, which is made of metal and on which a thread 4 is integrally provided for screwing a thread of a suitable design into an engine component. A center housing section 5 of housing 3 is provided with a compression and thermal sock zone 5*a* in the conventional manner. A tool engagement area 6 is also integrally provided on housing 3. Spark plug 1 further includes a connecting bolt 7, which is situated in the known manner on the inside of insulator 2 and is connected to center electrode 9*a*, for example, via an electrically conductive glass fuse and, in some cases, a contact pin.

Spark plug 1 thus has an end 10 on the combustion-chamber side in the area of electrodes 9*a*, 9*b* and a connection-side end 11 in the area of a connection-side end element 8. End element 8 may be designed, for example, as a connecting nut which is screwed onto a thread of connecting bolt 7 or, alternatively, as a plug-in element which forms a single unit with connecting bolt 7. A spark wire is then attached to connection-side end element 8 in a conventional manner.

In addition, a first sealing area 20 and a second sealing area 21 are provided between housing 3 and insulator 2. As shown in FIG. 1, the housing surrounds insulator 2, first sealing area 20 being situated closer to connection-side end 11 of the spark plug, and second sealing area 21 being situated closer to the combustion chamber.

As shown in FIG. 1, tool engagement area 6 is situated on the connection-side end of housing 3. For this purpose, housing 3 is extended over first sealing area 20 in the direction of connection-side end 11. Tool engagement area 6 is therefore situated in an area L1 between first sealing area 20 and connection-side end 11 of spark plug 1. In FIG. 1, L designates the total length of the spark plug. As a result, housing 3 no longer has to have a maximum diameter for a tool for fitting/removing spark plug 1, but rather it may have a maximum diameter D1 according to the functional requirements of the spark plug, in particular the thickness of the insulator. Since tool engagement area 6 is positioned a relatively great distance from end 10 on the combustion-chamber side and is situated in an area of the spark plug which has a reduced outer diameter, the maximum diameter of the tool engagement area may be substantially reduced, in particular to a wrench size of 12 or 13 in the case of thread M14 and an insulator head diameter of 10.5 mm. This reduces the outer diameter of the tool and thus also the amount of radial space required in the engine component.

The tool engagement area is also situated at a relatively great distance from end 10 on the combustion-chamber side. Up to this area, the engine must provide only enough radial space to accommodate the tool for fitting and removing the spark plug. In the area between the tool engagement area and outer sealing point 22, the physical volume required for the spark plug in the engine is specified only by the diameter of this sealing point 22. FIG. 1 shows tool engagement area 6 having a substantially reduced diameter D2. Diameter D2 corresponds, in particular, to a diameter of a tool having a wrench size of 12 or 13.

In this exemplary embodiment, tool engagement area 6 forms a single unit with housing 3. However, it should be noted that tool engagement area 6 may also be prefabricated as a separate part and may subsequently be joined to housing 3, for example by welding or soldering or gluing or caulking with housing 3.

As is further shown in FIG. 1, no additional physical volume for a tool which is needed to fit/remove spark plug 1 needs to be provided in an area L2 of the spark plug on a combustion-chamber side in an area immediately surrounding the spark plug. The necessary physical volume for a tool which engages in axial direction X-X of the spark plug must be provided only in the area surrounding tool engagement area 6 and is therefore located only in area L1 between first sealing area 20 and connection-side end 11 of spark plug 1. According to the present invention, tool engagement area 6 is therefore situated in a connection-side half of the spark plug. As a result, no additional radial physical volume for a tool needs to be provided in area L2 of spark plug 1 on the combustion-chamber side, so that other apparatuses situated on the combustion chamber, such as intake valves, exhaust valves, injection devices, etc., may be situated closer to the spark plug.

Figure 2A:
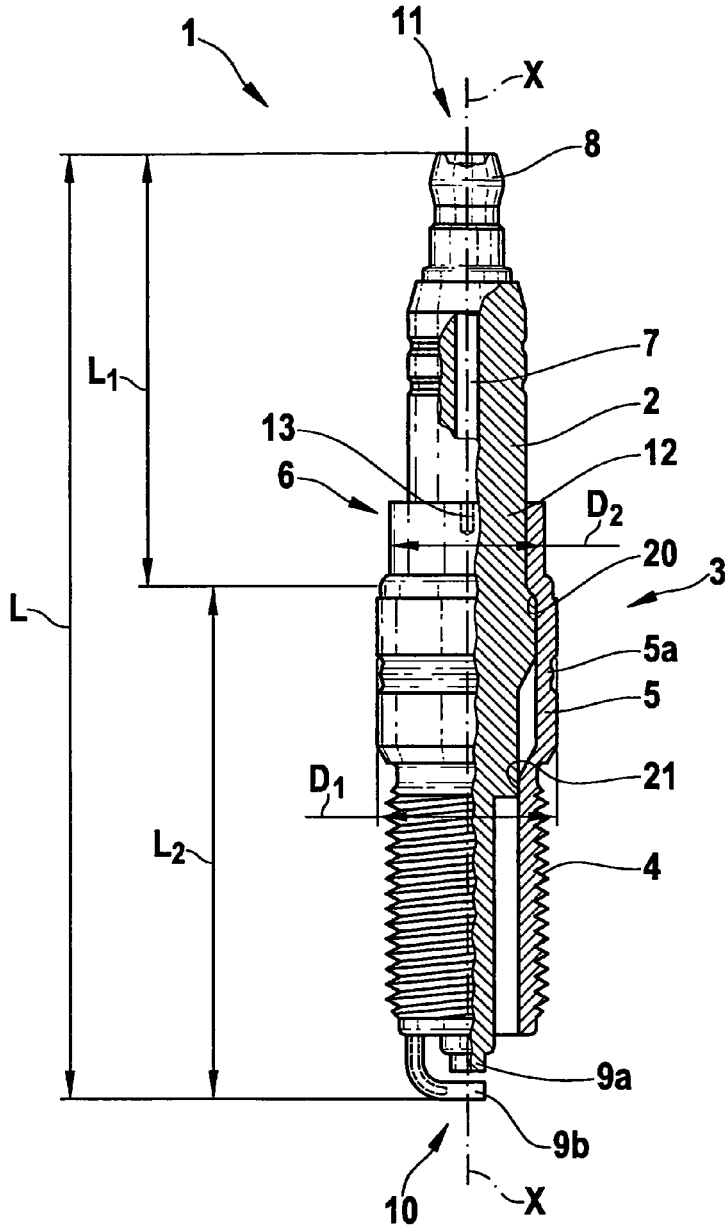
FIGS. 2*a* and 2*b* show schematic views of a spark plug according to a second exemplary embodiment of the present invention.
Figure 2B:
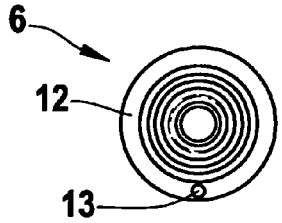

A spark plug 1 according to a second exemplary embodiment of the present invention is described in detail below with reference to FIGS. 2*a* and 2*b*. Equivalent or functionally equivalent parts are identified by the same reference numerals as in the first exemplary embodiment.

In contrast to the first exemplary embodiment, spark plug 1 in the second exemplary embodiment has a tool engagement area 6 of an alternative design. As shown in FIGS. 2*a* and 2*b*, tool engagement area 6 is formed by a sleeve-like area 12 which forms a single unit with housing 3. Sleeve-like area 12 is again situated downstream from first sealing area 20 in the direction of end 11 on the combustion-chamber side. A bore 13, which is used to accommodate a correspondingly designed fitting tool (not illustrated), is provided in ring-shaped, sleeve-like area 12. When the fitting tool is attached to ring-shaped, sleeve-like area 12, a torque is thereby transmittable to spark plug 1 via an element of the tool projecting into bore 13 and via bore 13. This makes it possible to easily fit and remove the spark plug. Ring-shaped sleeve area 12 may be provided in a particularly simple and cost-effective manner. The outer diameter of the tool is preferably smaller than the maximum outer diameter of the spark plug housing. Additional physical volume for the tool is therefore not needed in the engine. In other respects, this exemplary embodiment corresponds to the first exemplary embodiment, so that reference may be made to the description provided therefor.

Figure 3A:
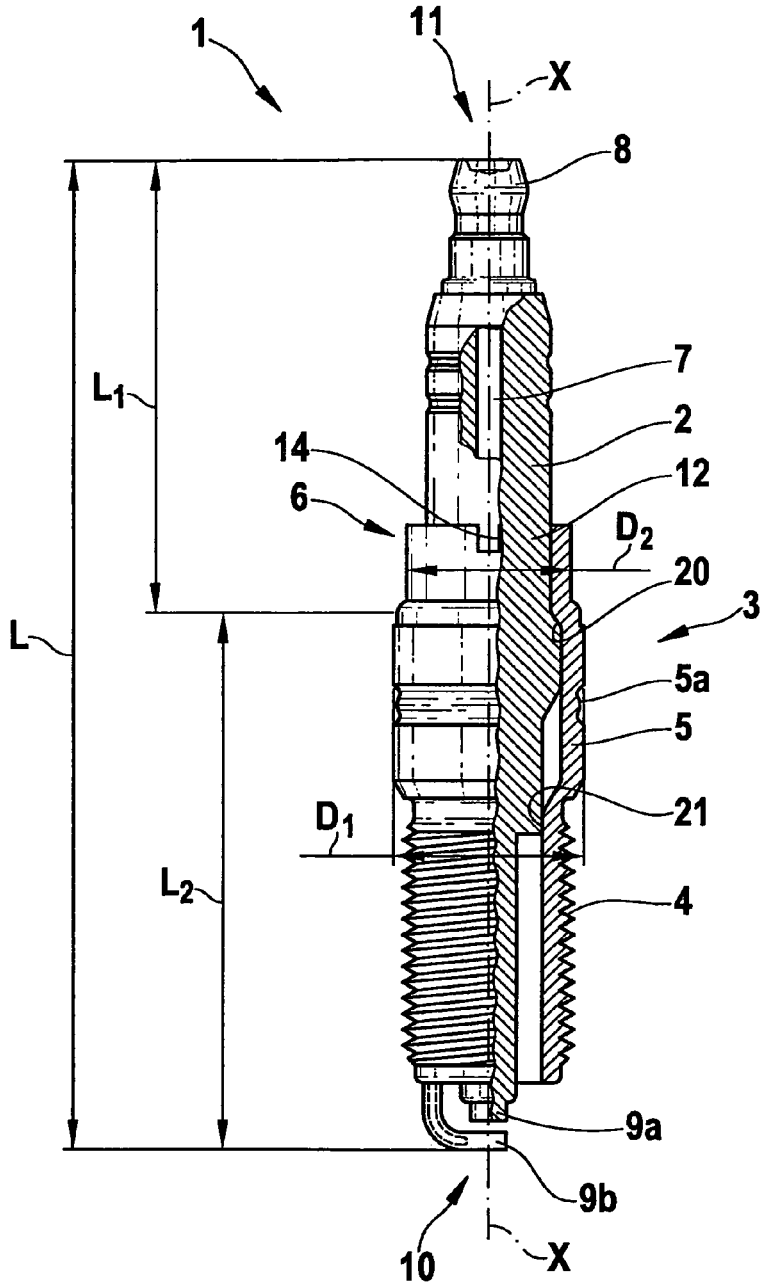
FIGS. 3*a* and 3*b* show schematic views of a spark plug according to a third exemplary embodiment of the present invention.
Figure 3B:
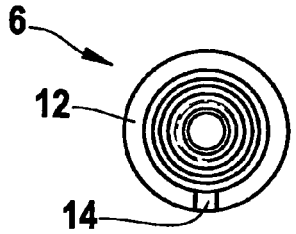

A spark plug 1 according to a third exemplary embodiment of the present invention is described below with reference to FIGS. 3*a* and 3*b*. Equivalent or functionally equivalent parts are again identified by the same reference numerals as in the first exemplary embodiment.

The third exemplary embodiment generally corresponds to the second exemplary embodiment, a radial groove 14 being provided in the third exemplary embodiment on a ring-shaped sleeve area 12, which forms a single unit with housing 3. Like bore 13 in the second exemplary embodiment, radial groove 14 in the third exemplary embodiment is used to transmit, to spark plug 1, a torque which is applied to a tool having a matching design (not shown). In other respects, this exemplary embodiment corresponds to the preceding exemplary embodiments, so that reference may be made to the description provided therefor.

Figure 4:
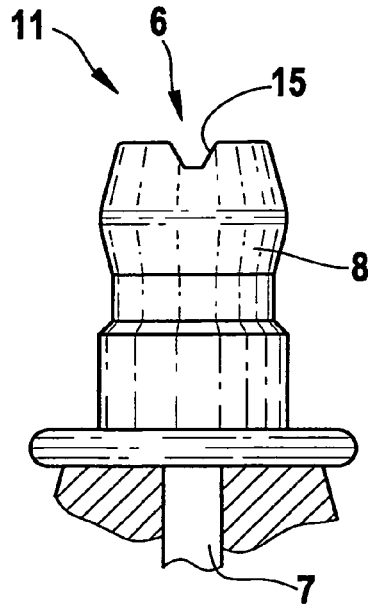
FIG. 4 shows a schematic view of an electrical connecting arrangement for a spark plug according to a fourth exemplary embodiment of the present invention.

A spark plug according to a fourth exemplary embodiment of the present invention is described below with reference to FIG. 4. Equivalent or functionally equivalent parts are again identified by the same reference numerals as in the preceding exemplary embodiments.

The spark plug in the fourth exemplary embodiment has a tool engagement area 6 which is situated directly on connection-side end 11 of the spark plug. Connecting bolt 7 has a connection-side end element 8, which forms a single unit with connecting bolt 7. Alternatively, it is possible to screw on or caulk over the connecting bolt. A groove 15 which is able to transmit a torque to spark plug 1 via a correspondingly designed tool is provided in connection-side end element 8. Groove 15 runs around the entire diameter of the connection-side end of end element 8. A tool designed to correspond to groove 15 may be, for example, a normal slot-head screwdriver.

In the fourth exemplary embodiment, tool engagement area 6 is therefore situated on connection-side end 11 of the spark plug. This makes it possible to eliminate a physical volume needed for the spark plug along the entire circumference of the spark plug, in particular also for a tool for changing the spark plug. This makes it possible to provide a particularly narrow spark plug, which has only a small outer diameter. In other respects, this exemplary embodiment corresponds to the preceding exemplary embodiments, so that reference may be made to the description provided therefor.

Figure 5A:
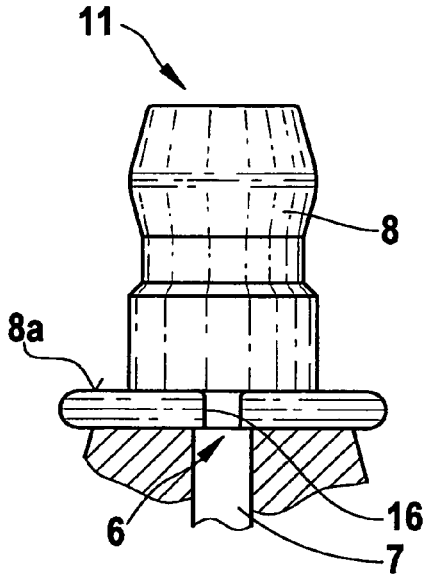
FIGS. 5*a* and 5*b* show schematic views of a connection means for a spark plug according to a fifth exemplary embodiment of the present invention.
Figure 5B:
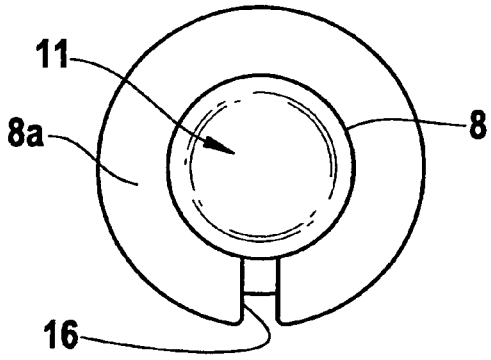

A spark plug according to a fifth exemplary embodiment of the present invention is described below with reference to FIGS. 5*a* and 5*b*, equivalent or functionally equivalent parts being identified by the same reference numerals as in the preceding exemplary embodiments.

The fifth exemplary embodiment generally corresponds to the fourth exemplary embodiment, a tool engagement area 6 in the fifth exemplary embodiment being situated on the side of a connection-side end element 8 of the spark plug. In particular, tool engagement area 6 is provided with a side groove 16 on a supporting surface 8*a* of end element 8. End element 8 again forms a single unit with connecting bolt 7. A torque is also again applied to the spark plug by a tool designed to match side groove 16 and provided in end element 8. In other respects, this exemplary embodiment corresponds to the preceding exemplary embodiments, so that reference may be made to the description provided therefor.

Connection-side end element 8 includes a radially projecting supporting surface 8*a* via which the end element rests against insulator 2 of spark plug 1.

What is claimed is:

1. A spark plug for an internal combustion engine, comprising:

an electrical connecting arrangement on a connection-side end, wherein the connection-side end includes a connection-side end element for providing the electrical connection of the spark plug;

an end on a combustion-chamber side pointing toward a combustion chamber;

an insulator;

a housing having a thread to attach the spark plug to an engine component;

a first sealing area, and a second sealing area situated between the insulator and the housing, the first sealing area being situated closer to the connection-side end and the second sealing area being situated closer to the end on the combustion-chamber side; and a tool engagement area to transmit a torque to the spark plug for fitting or removing the spark plug, the tool engagement area being situated in an area of the spark plug which lies between the connection-side end element and the first sealing area wherein a maximum diameter of the housing is greater than or equal to a maximum diameter of the tool engagement area.

2. The spark plug as recited in claim 1, wherein the tool engagement area is designed as a hexagon having a wrench size of 12 or 13.

3. The spark plug as recited in claim 1, wherein the tool engagement area includes a sleeve area having a tool engagement arrangement.

4. The spark plug as recited in claim 3, wherein the tool engagement arrangement is at least one of i) at least one bore, and ii) at least one groove.

5. The spark plug as recited in claim 1, wherein the tool engagement area is provided as a single unit on the housing of the spark plug.

6. The spark plug as recited in claim 1, wherein the spark plug one of: i) has electrodes on its end on the combustion-chamber side, or ii) is a laser spark plug.

7. The spark plug as recited in claim 1, wherein the tool engagement area is provided at an end of the housing and proximate to the first sealing area when compared with the connection-side end element.

8. The spark plug as recited in claim 1, wherein the connection-side end element is one of (i) a connecting nut which is screwed onto a thread of a connecting bolt and (ii) a plug-in element which forms a single unit with the connecting bolt.

* * * * *

UNITED STATES PATENT AND TRADEMARK OFFICE

CERTIFICATE OF CORRECTION

PATENT NO. : 8,373,337 B2
APPLICATION NO. : 12/308480
DATED : February 12, 2013
INVENTOR(S) : Kaiser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 992 days.

Signed and Sealed this
First Day of September, 2015

Michelle K. Lee

Michelle K. Lee
*Director of the United States Patent and Trademark Office*